US006723013B2

(12) United States Patent
Ilcisin et al.

(10) Patent No.: US 6,723,013 B2
(45) Date of Patent: Apr. 20, 2004

(54) DAY AND NIGHT CROQUET AND BOCCE

(75) Inventors: Kevin J. Ilcisin, Beaverton, OR (US); Thomas S. Buzak, Beaverton, OR (US)

(73) Assignee: Technical Visions Inc., Beaverton, OR (US)

( * ) Notice: Subject to any disclaimer, the term of this patent is extended or adjusted under 35 U.S.C. 154(b) by 0 days.

(21) Appl. No.: 10/455,991

(22) Filed: Jun. 5, 2003

(65) Prior Publication Data

US 2003/0199343 A1 Oct. 23, 2003

Related U.S. Application Data

(63) Continuation-in-part of application No. 09/586,448, filed on Jun. 2, 2000, now Pat. No. 6,575,855

(60) Provisional application No. 60/175,120, filed on Jan. 6, 2000.

(51) Int. Cl.[7] ..... A63B 43/06

(52) U.S. Cl. ..... 473/570; 473/604

(58) Field of Search ..... 473/569, 594, 473/570, 604; 273/DIG. 8; 362/790

(56) References Cited

U.S. PATENT DOCUMENTS

| | | | | | |
|---|---|---|---|---|---|
| 3,229,976 | A | | 1/1966 | Allen | |
| 3,304,651 | A | | 2/1967 | Woosley | |
| 4,002,893 | A | * | 1/1977 | Newcomb et al. | 473/570 |
| 4,133,528 | A | * | 1/1979 | Koblick | 473/570 |
| 4,448,418 | A | | 5/1984 | McHeill | |
| 4,479,649 | A | * | 10/1984 | Newcomb et al. | 473/570 |
| 4,878,674 | A | | 11/1989 | Newcomb et al. | |
| 4,930,776 | A | | 6/1990 | Newcomb et al. | |
| 4,957,297 | A | | 9/1990 | Newcomb et al. | |
| 4,963,117 | A | | 10/1990 | Gualdoni | |
| 5,054,778 | A | | 10/1991 | Maleyko | |
| 5,080,359 | A | | 1/1992 | Thill | |
| 5,370,390 | A | | 12/1994 | Swanson | |
| 5,403,000 | A | | 4/1995 | Woosley | |
| 5,595,388 | A | | 1/1997 | Swigart | |
| 5,607,226 | A | | 3/1997 | Toth et al. | |
| 5,611,720 | A | | 3/1997 | Vandermaas | |
| 5,683,316 | A | | 11/1997 | Campbell | |
| 5,700,211 | A | * | 12/1997 | Mackie | 473/613 |
| 5,762,573 | A | * | 6/1998 | Kennedy et al. | 473/570 |
| 5,882,239 | A | | 3/1999 | Trichak | |
| 6,080,067 | A | * | 6/2000 | Leff | 472/63 |
| 6,428,432 | B1 | | 8/2002 | Kachel | |
| 6,575,855 | B1 | * | 6/2003 | Buzak et al. | 473/569 |

* cited by examiner

*Primary Examiner*—Gregory Vidovich
*Assistant Examiner*—Nini F. Legesse
(74) *Attorney, Agent, or Firm*—ipsolon llp

(57) ABSTRACT

Chemoluminescent illuminators are used to provide night visible game equipment, notably, croquet and bocce. The balls are hollow metal spheres having plural openings and light stick receptors to retain the light stick in the ball. Light emitted from the light stick escapes from the opaque balls through the openings. The interior surface of the sphere may be treated in a variety of ways to increase light scattering within the hollow interior to define an integrating sphere. Different colored illuminators are provided to mark different balls as relating to different players. Wickets preferably comprise elongate chemoluminescent illuminators that are held in proximity to conventional wickets with torsional springs or with loops formed in the wickets. Wicket holders may also be provided to assist with directly supporting the chemoluminescent illuminators that are used as wickets. Stakes and mallets are provided with receptacles to accept chemoluminescent illuminators so as to illuminate the stakes for nighttime visibility.

20 Claims, 3 Drawing Sheets

DAY AND NIGHT CROQUET AND BOCCE

FIELD OF THE INVENTION

This invention relates to games and game equipment. More specifically, the invention relates to the games of croquet and bocce (lawn bowling), and to equipment for use in these games that allows play in either light or dark conditions.

BACKGROUND OF THE INVENTION

Croquet and bocce are popular games that are enjoyed by many players. Briefly described, croquet play requires that a series of hoops or wickets are inserted into a playing surface, such as a lawn, to provide gates through which the croquet balls must pass in order for an individual player to advance his position in the game. Each player, in turn, strikes his or her croquet ball with a mallet to drive the ball in a specific order through the wickets. One goal of the game is to be the first to progress through the course of wickets.

Bocce, which is often called lawn bowling, is played on a court divided by a centerline. Play is begun by one team tossing a relatively small marker ball, sometimes called a "pallino", to act as a target for subsequent play. Each team then rolls their bocce balls in alternating turns (typically a total of eight balls, four for each of two teams) toward the pallino, with the goal being to roll the balls such that they are closer to the pallino than the opposing team's balls. Play continues until all balls have been thrown—the team with the balls closest to the pallino is awarded points. The team that wins one frame begins the next frame by again throwing the pallino.

Bocce is a very different game from croquet. But like croquet, bocce requires the use of balls, and the game is best suited to outdoor play on a surface such as a lawn. While specialized bocce balls are available from many different sources, croquet balls work well as bocce balls and many players use the same balls for both games.

Both croquet and bocce are typically played during daylight hours since during dark periods it is difficult to see the playing equipment. Nonetheless, many players would like to continue play after dark if they could. Absent an externally lighted court, which would be expensive to build and maintain and therefore not a possibility for most players, play after dark is either not possible, or at least very difficult. The limitations imposed by darkness are of course common to many games, and various solutions have been developed. However, none of the known equipment that has been developed for the play of games after dark is suitably modified for use with the equipment used in croquet and bocce.

One solution to the problems associated with the play of games at night is to use LEDs to illuminate game equipment. Vandermaas in U.S. Pat. No. 5,611,720 and Toth et al. in U.S. Pat. No. 5,607,226 describe a means for making sports equipment useable after dark by embedding LEDs into the devices. Vandermass' patent discloses a flying disk toy that has a plurality of LEDs arranged around a raised center section. A fairly complicated switching mechanism, activated by rotational movement of the disk to intermittently open and close the electrical circuit, intermittently illuminates the LEDs to cause a rapid flashing effect. Toth et al. describes street hockey equipment that is illuminated by LEDs contained in the equipment (i.e., the stick, puck and goal posts). But wherever LEDs are used, the equipment requires the use of batteries to provide a source of electrical current to illuminate the LEDs. This is not desirable because the batteries need to be replaced, and fresh batteries may not be readily available when they are needed. In addition, and as a consequence of the battery issue, these approaches use intermittently illumination to extend the battery life. Turning on of the device is accomplished by the initial mechanical shock. This is suitable for games like hockey or throwing Frisbee where there is constant motion of the equipment, but in the case of games such as bocce or croquet, there are long periods during which the ball is at rest. Finally, the Vandermaas and Toth et al. inventions require electronic circuits that may not be well suited to strong, repeated mechanical shock, although a hockey stick and puck certainly would be exposed to such shock.

Swigert in U.S. Pat. No. 5,595,388 describes a dark court game apparatus that utilizes equipment that is modified to reflect the light provided by illumination sources on the perimeter or bottom of the game area. Such inventions are not suitable for use outdoors or away from sources of power for the illumination. In addition, significant preparation of the court is required prior to use, which limits the ease of use.

Other prior art relies upon chemical illuminants to modify game equipment for use during the night. For instance, Newcomb et al, in U.S. Pat. No. 4,930,776 describes a technique for inserting a chemical illuminant into a translucent, thin walled ball that is required to have many holes on the surface. The "light stick" is formed into a circular ring, thereby activating the chemoluminescent chemicals contained in the stick. The ring is then inserted into the ball through one of the holes on the surface. Such a design is not suitable for sports such as croquet or bocce, both of which require the ball to be reasonably heavy in comparison to the described Wiffle® ball. Moreover, in the disclosed ball the light stick defines an equatorial member that has a mass extending around the ball's equator, just inwardly of the relatively thin outer wall. This structure results in a ball having unequal equal rotational moments of inertia around different axes, which in turn will cause the ball to wobble as it is rolled across a surface. While such uneven rotational movement may be desirable, or at least acceptable in a lightweight Wiffle® ball, it is unacceptable in a croquet and bocce ball.

Similarly, Thill, in U.S. Pat. No. 5,080,359, describes another thin shelled ball which includes doors fabricated into the surface of the ball with living hinges to allow insertion of the chemoluminescent device into the hollow cavity of the ball. The ball disclosed by Thill suffers the same rotational movement problems as the Newcomb et al. ball described above. Moreover, Thill's combination of a thin-shelled ball having hinged doors make the balls unsuitable for use in croquet or bocce.

Woosley in U.S. Pat. No. 5,403,000 describes yet another variant of a ball game that utilizes chemoluminescent devices to illuminate the equipment. Like Newcomb et al. and Thill, Woosley's ball has a relatively thin skin, and in this case is inflatable, as in the case of a basketball. The nominally opaque ball includes selected areas that are of reduced thickness and which are translucent or transparent (for instance, the seams on a basketball). A chemoluminescent capsule is inserted into a transparent or translucent housing attached to the shell of the ball. Light from the capsule is visible through the thinned seams. As with the balls described above, the Woosley ball results in the destruction of the degeneracy of the moment of inertia since the ball will have three very different moments of inertia. Not only would this ball thus have wobble problems when rolled, but the because the ball is relatively thin-skinned and inflated, it is not adaptable for croquet or bocce as the ball needs to be nominally heavy and translucent for excellent visibility at night. Woosley also describes using illuminants attached to standard basketball hoops or nets with removable clips to allow for night play. Such removable clips are not suitable for use with a croquet wicket because they could be knocked off the wicket and lost in the lawn. The clips could eventually be picked up by a lawnmower and destroyed and possibly turning into a dangerous projectile.

Finally, a known product is being sold using batteries and LEDs to illuminate bocce balls. This product is called Skizzo and is produced by Knight Sports of 508 S. Wilson St., Kennewick, Wash. 99336. This product is for lawn bowling games only, and not croquet. The balls reportedly weigh about 6.2 ounces with batteries and are slightly weighted on one side. Being differentially weighted on one side, these Skizzo balls plainly suffer from the uneven rotational movement described above, though the manufacturers of the product tout this as a means of creating more of a challenge to players. In addition, this product has the disadvantages of the need for batteries, the relatively light weight of the balls, and electronics that may be broken with severe mechanical shock.

There is a need, therefore, for equipment designed for use in the games of croquet and bocce that address the problems found in the prior art.

SUMMARY OF THE INVENTION

The present invention uses commercially available chemoluminescent light sticks as an illuminant to illuminate the balls used in lawn games such as bocce, as well as croquet. In one illustrated embodiment the game ball is a hollow sphere fabricated from an opaque material having a diffuse, reflecting inner surface to reflect light from an internal light source. The sphere includes multiple holes through the surface allowing light from the light source to escape, thereby making the ball visible for nighttime play. The interior surface of the sphere may be treated to increase light scattering within the sphere, and to thereby increase nighttime visibility of the ball.

The present invention also is embodied in wickets adapted for use with chemoluminscent necklaces for use at night, and which may also be used during daylight. Stakes and mallets that are used in the play of croquet are adapted for enhancing play of croquet during dark hours.

BRIEF DESCRIPTION OF THE DRAWINGS

The invention will be better understood, and the numerous objects and advantages of the invention will be apparent by reference to the following detailed description of the invention when taken in conjunction with the following drawings.

DETAILED DESCRIPTION OF PREFERRED EMBODIMENTS

The following detailed description of various embodiments is made with respect primarily to croquet and the equipment used in the game. It will be appreciated that because all of the features described for croquet carry over to equipment used in lawn bowling games such as bocce, the invention is not limited to croquet.

In this invention, commercially available chemoluminescent illuminators (available from companies such as Omniglow Corporation, 96 Windsor Street, West Springfield, Mass. [www.omniglow.com]) are used in novel ways to illuminate uniquely designed balls, wickets, stakes and mallets, and to provide a novel means for providing equipment for use in night or day time (i.e., dark or light) conditions. Equivalent chemoluminescent illuminators acceptable for use in connection with the present invention are available from a variety of other sources. Generally described, the light sticks are hollow, pliable plastic rods that are available in various lengths. Sealed inside the rods are two or more liquids. At least one of the liquids is further sealed in a breakable ampule or ampules (such as glass) that keeps the liquids separated until illumination is desired. Bending the rod breaks the internally contained glass ampule allowing the previously separated liquids to intermix. When the liquids mix, a chemical reaction is initiated that releases light. An observer can see the light that passes through the plastic rod. The color of the perceived light from the chemoluminescent sticks may be varied by inclusion of various chemicals in the liquids. For purposes of this invention, the standard colors for croquet balls are blue, red, black, yellow, green, and orange. With the exception of black, all of these colors are available in light sticks. Since black cannot be used as an illuminant color for nighttime play, it must be replaced with another color such as purple.

The manner of playing croquet and bocce with the present invention does not vary from the well-known rules of play, except that the invention allows the games to be played in the dark. The invention will be described therefore with reference to the pieces of equipment that are used in the game. For croquet, that equipment includes balls, wickets, stakes and mallets. Bocce only requires the use of balls, and it will be understood that the croquet balls described below are well suited for bocce. Bocce also requires the use of a relatively smaller pallino. The principles of this invention are not limited to balls of any particular size, and the principles described below with reference to a croquet or bocce ball apply equally to the smaller pallino, or to regulation bocce balls whose diameter is somewhat larger than that of standard croquet balls.

Balls

Some principals of game ball and equipment construction are explained in detail in our prior application Ser. No.

09/586,448, U.S. Pat. No. 6,575,855, which is incorporated herein by this reference.

Figure 1:
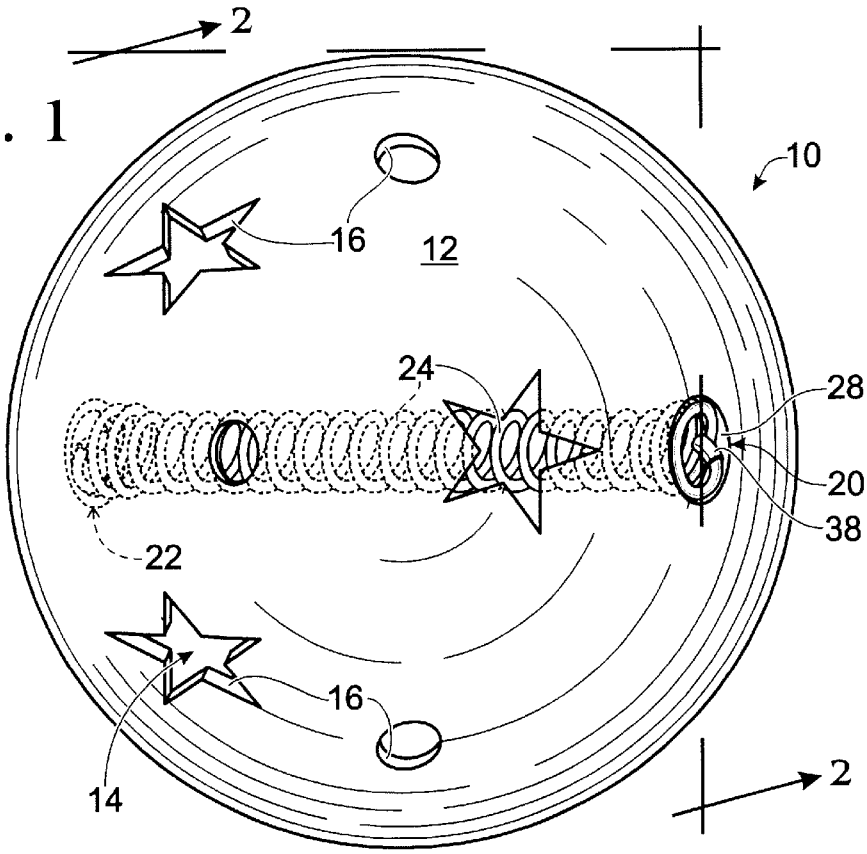
FIG. 1 is an elevational view of a first embodiment of a game ball according to the illustrated invention, showing the internal light stick holder in phantom lines.

With reference now to FIG. 1, a first embodiment of a croquet ball 10 according to the present invention is shown in side view. The design of ball 10 must simultaneously satisfy requirements for adequate weight, good impact resistance, low cost of fabrication, high perceived brightness, low material cost, and good balance. Before describing specific embodiments of ball 10, certain general attributes of the ball will be described.

In all cases the ball must have sufficient mass to be effective as a croquet (or bocce) ball. In both croquet and bocce, the balls collide with one another. Sometimes this is an unintended consequence of play, and sometimes collisions are intentional. Inflatable balls such as basketballs have a relatively lower mass to volume ratio as compared to a relatively more massive ball like a croquet ball.

Given that collisions are inevitable, indeed intended, ball 10 must be impact resistant. Accordingly, a preferred ball 10 according to the illustrated invention is made of metal and has a wall thickness sufficient to provide adequate weight and impact resistance, and also embody good rolling and rebounding characteristics. While metal is the preferred material, other materials also may be used to fabricate the game balls 10, including various impact resistant plastics and the like.

Ball 10 shown in FIG. 1 is a preferred embodiment of a metallic ball that is defined by a spherical metal shell having a wall 13. In the preferred embodiment, wall 13 is opaque. Metal is the preferred material for fabricating ball 10 for various reasons, detailed below, and metal is of course opaque. Nonetheless, ball 10 is not limited to metal and some plastics may be used to fabricate ball 10. However, metal is the preferred material to avoid problems with cracking or fracture due to impacts incurred during the normal course of play. Ball 10 comprises a hollow sphere—in the figures the hollow interior of ball 10 is represented with reference number 14. The outer surface 12 of ball 10 may be painted or surface-coated in any desired fashion or color scheme. Ball 10 includes a plurality of holes 16 that open to the hollow interior 14 and, as described below, allow light from an internal light source to escape from the hollow interior of ball 10. The number, location and shape of holes 16 may be varied widely, and will depend to some extent on the size of ball 10. As shown in the figures, the holes may be of various fanciful shapes such as stars, crescent moons, and virtually any other geometric shapes.

A pair of opposed openings 20 and 22 are formed through wall 13 and define an axial centerline through ball 10 that serves as a receptacle for retaining the internal light source. The preferred structure for retaining the internal light source within the hollow interior 14 of ball 10 is a helical spring 24 that is configured to retain a chemoluminescent light stick 26 inside the ball, yet allows for easy removal of a spent light stick and replacement with a fresh light stick. With reference to FIG. 1, each of the opposed openings 20 and 22 includes a circumferential lip 28 that is recessed slightly below the outer surface 12 of ball 10. The opposite ends of spring 24 are designed to be captured in openings 20 and 22 and remain in place through repeated shock caused by collision of ball 10 with mallets, other balls and the like. Thus, the helical pitch of spring 24 at first end 30 decreases, and the helical diameter increases to a diameter that is greater than the diameter of opening 20. Accordingly, the first end 30 of spring 24 may be captured in opening 20 by virtue of the outer few turns of spring 24 engaging lip 28. Because lip 28 is slightly recessed, the spring does not extend outwardly beyond the outer surface 12 of ball 10, thereby preventing disruption of the ball's rotation when the ball rolls over smooth surfaces. Likewise, the helical pitch of spring 24 at second end 32 decreases, and the helical diameter increases so that the opposite end of the spring may be captured in opening 22 such that the spring does not extend outwardly of the outer surface 12.

Figure 2:
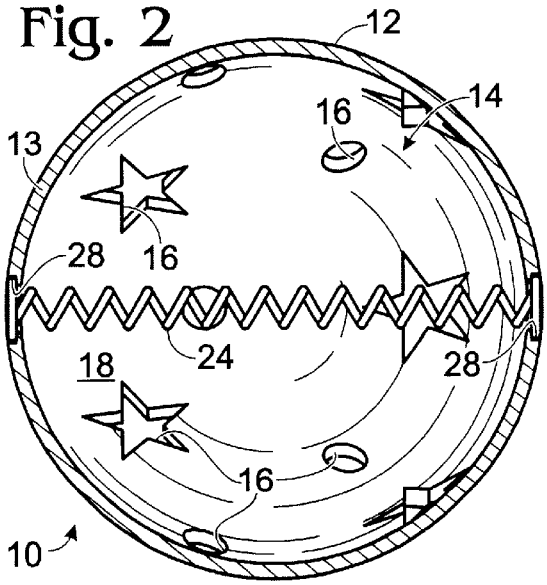
FIG. 2 is a cross sectional view of the game ball shown in FIG. 1 taken along the line 2—2 of FIG. 1, but showing the entire internal light stick holder.
Figure 4:
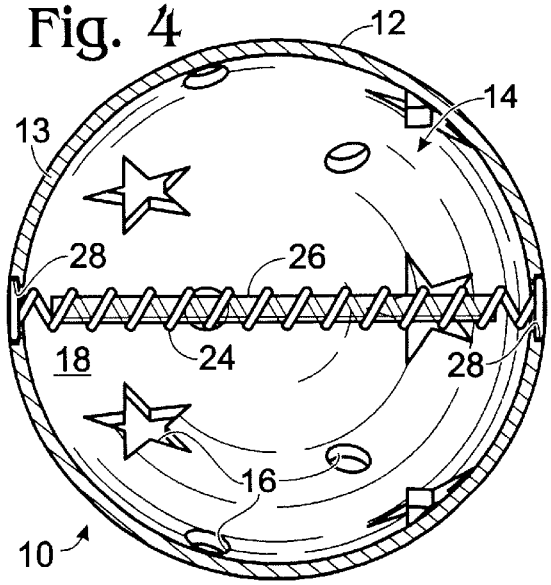
FIG. 4 is a cross sectional view of the game ball shown in FIG. 1 taken along the line 2—2 of FIG. 1 and similar to the illustration of FIG. 2, but showing a light stick inserted into the internal light stick holder.

The helical pitch of spring 24 between the first and second ends 30 and 32—that is, in that portion of the spring in the interior 14 of ball 10—increases, as best illustrated in FIGS. 2 and 4, to minimize the light blocked by the spring.

Figure 3:
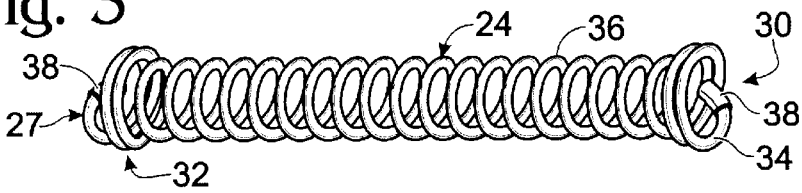
FIG. 3 is a perspective view one illustrated embodiment of a light stick holder.

The spring 24 defines a cylindrical tube 27 that has an interior diameter somewhat greater than the diameter of a light stick 26. This allows the light stick to move longitudinally within the tube 27 defined by the spring—the length of the light stick is, as illustrated in FIG. 4, slightly shorter than the diameter of ball 10 so that the light stick is completely received into the spring within the hollow interior 14. The ends of the wire 36 used to fabricate spring 24 are bent inwardly, toward the center of the cylindrical tube 27 to provide a means for capturing the light stick within the spring 24, in tube 27, yet allowing easy removal of the light stick from tube 27 and replacement of the spent light stick with a new one. Specifically with reference to FIG. 3, the end 34 of wire 36 from which spring 24 is fabricated is bent inwardly so that the end of the wire partially bisects the tubular cylinder 27 defined by the spring. A short length of heat-shrink tubing 38 is inserted over the end of wire 36 to eliminate a sharp end. The bent over end 34 of wire 36 prevents light stick 26 from slipping out of the cylinder defined by the spring. However, the bent over end 34 may be easily pushed aside to allow a fresh light stick to be inserted into the cylinder when one light stick is depleted; the new light stick pushes the old light stick out through the opposite end.

It will be appreciated that while the wire spring 24 just described is one preferred means of retaining the light stick in the hollow interior 14, the spring may be replaced by numerous equivalent structures. For example, any structure that defines a tube that retains the light stick and allows light to escape may be used—a clear plastic tube, for example. Nonetheless, a metal spring is convenient owing to its low cost to manufacture, durability and longevity.

Turning now to FIG. 2, the interior surface 18 of ball 10 is designed to reflect and scatter light from the internal light source to enhance the amount of light that is visible through holes 16. The majority of light that is emitted from the internal light source strikes the interior surface 18 where it is reflected or scattered in a new direction. If the interior surface has a non-reflecting or insufficiently reflecting surface coating or if the coating is, for example, too thin, then the reflected light is attenuated each time the light strikes the interior surface, and the amount of light escaping through a hole 16 is decreased inordinately. On the other hand, if the interior surface 18 is treated with a surface coating that is sufficiently reflective then the amount and intensity of the light trapped in the hollow interior 14 is improved. This concept is similar to an integrating sphere, which is a sphere used in connection with certain types of optical instruments; an integrating sphere includes a spherical interior surface and a light source directed towards the interior—the interior surface is coated to enhance reflectivity and scattering of the light from the light source. Unlike optical integrating spheres, however, the ball 10 illustrated herein has holes 16 through which light escapes. Because the interior surface 18 is provided with a reflective coating, the amount, intensity and quality of the light that escapes through holes 16 is improved. The interior surface 18 thus defines a light-reflecting surface and the ball 10 is referred to as an integrating sphere. This may be accomplished using a variety of methods. The preferred method is to coat the interior surface 18 with a light-reflecting coating such as a white or light-colored paint, plastic or similar coating material that has sufficient reflectivity and thickness to enhance the reflectivity of the surface to enhance integration of light in the hollow interior 14. The coating may be textured if desired to increase light scattering. Other light reflecting and scattering treatments and methods may likewise be used with interior surface 18, including for example use of surface texturing, surface texturing, and the use of small, reflective and scattering surfaces such as small mirrored facets oriented in random directions and adhered to interior surface 18. Because the wall 13 of ball 10 is opaque, the light that escapes from the interior 14 must escape through holes in the wall. Because the interior surface defines a light-reflecting surface, the amount and intensity of escaping light is enhanced.

It should be noted that although the ball 10 is described herein as incorporating a chemoluminescent light source, it will be appreciated that invention is not limited to such a light source. The principal of an integrating sphere in a game ball thus includes other light sources, such as LEDs, etc.

The weight and balance of ball 10 is important and the ball preferably has equal or nearly equal rotational moments of inertia in order to roll without wobble. In order for a ball 10 to roll smoothly, the moments of inertia. In a massive sphere that must roll with no appreciable wobble, it is necessary to consider mass distribution within the ball, and variations in that mass distribution resulting from a light stick 26 held axially within the hollow interior 14 of the ball. While a solid ball will have good rotational dynamics, even when holding a light stick, it is more difficult to avoid rolling-induced wobble with a hollow ball.

Since the volume of a sphere is proportional to the cube of its radius, a disproportionate fraction of the mass of a ball is located in the large radiuses near the surface. This means that if the outer mass—that is, the mass contributed by wall 13—is distributed uniformly, the moment of inertia of the ball around all axes will be identical, or close to identical. Since the outer mass represents the majority of the mass of hollow ball 10, it will dominate the rotational behavior of the ball, even when perturbed by a small asymmetrical mass near the center, such as the mass contributed by light stick 26 and spring 24.

A metal ball 10 such as that described above is advantageous because the weight of the ball is located near the large radiuses and may be varied by changing the thickness of the wall 13. As an example, for a croquet ball having a diameter of about 3.3 inches (a standard size for a croquet ball), a wall 13 having a thickness nominally of about 0.075 inches results in a ball having approximately the same weight as many commercially available plastic croquet balls. A hollow metal ball having a wall thickness of 0.075 inches is preferably made of hardened steel in order to provide sufficient strength to withstand being struck by a mallet and other balls. Any hardening method may be used, such as heating the balls in a carbon enriched environment, quenching the environment to a lower temperature, and tempering the metal to reduce brittleness.

In addition, a metal hollow sphere as described above is advantageous because to additional internal structure is needed to add weight to the ball—the thin shell of metal has about the same weight as a solid plastic ball. Assuming that the light-emitting holes 16 are fairly evenly distributed over the surface of the sphere, the rotatational moments of inertia around all rotational axes are essentially equal. This allows the ball 10 to roll without any appreciable wobble, regardless of the weight added by spring 24 and the light stick 26 contained therein.

Chemoluminescent light sticks 26 of a suitable size include light sticks that are approximately 75 mm in length and 7.5 mm in diameter. Unlike LEDs the light sticks are flexible, are available in all of the needed colors, and their light emitting properties are not affected by mechanical shock. And while the present invention is described with reference to a light stick, it will be appreciated that chemoluminescent light sources are available in a variety of geometric configurations, and many such configurations are adequate sources of illumination material.

Most of the light emitted from the chemoluminescent light stick 26 strikes the interior surface 18 of ball 10. However, because the interior surface 18 is treated as described above to increase the light scattering ability of the surface, and because ball 10 includes plural holes 16, a significant amount of light from the light stick 26 escapes the ball. This allows the ball to be easily seen during nighttime play.

Wickets

Conventional croquet wickets are typically made of metal wire coated with a white paint or plastic material. Although they are often colored white, these conventional wickets become difficult or impossible to see in low light conditions, limiting play to daytime conditions. As such, to facilitate nighttime play, the present invention relies upon the light emitting properties of chemoluminescent illuminators to provide a glowing wicket as an adjunct to conventional wickets. A typical preferred chemoluminescent product suitable for use in connection with this invention is a single or multicolor chemoluminescent "necklace," although the shorter light sticks described above also will function to illuminate the wickets. The necklaces are hollow plastic rods that are commercially available (for instance, from Omniglow Corp.), and which are preferably approximately 22 inches long. These necklaces have several properties that make them suitable for use with the present invention. Since they are straight in their initial non-luminous state, the chemoluminescent necklaces may be bundled, packaged, and shipped in a configuration taking up as little volume as possible. After bending and activation the chemoluminescent wickets glow for hours, providing time for many croquet games. The flexibility of the chemoluminescent necklace allows it to be easily and bent into the hoop shape of the wicket.

In the prior art patent to Woosley described above, clip-like retainers for holding chemoluminescent wands may be attached to and removed from holders such as a basketball rim. If removable clips such as those described by Woosley were used with conventional croquet wickets, the clips could be knocked off if a croquet ball of sufficient force struck the wicket. Not only is this inconvenient, resulting in the interruption of the game and potential loss of the retainer clips in the lawn during nighttime play, but the lost parts could also be eventually picked up by a lawnmower, destroying the part and possibly turning it into a dangerous projectile.

In a croquet set according to the present invention, it is desirable to have a set of conventional wickets as well as the wickets that allow for nighttime play. Although spent glow wickets as described below are also suitable for daytime play, it is desirable to have conventional wickets for first time play in daylight, so that the glowing feature of the glow wickets is not "wasted" in daylight.

Figure 5:
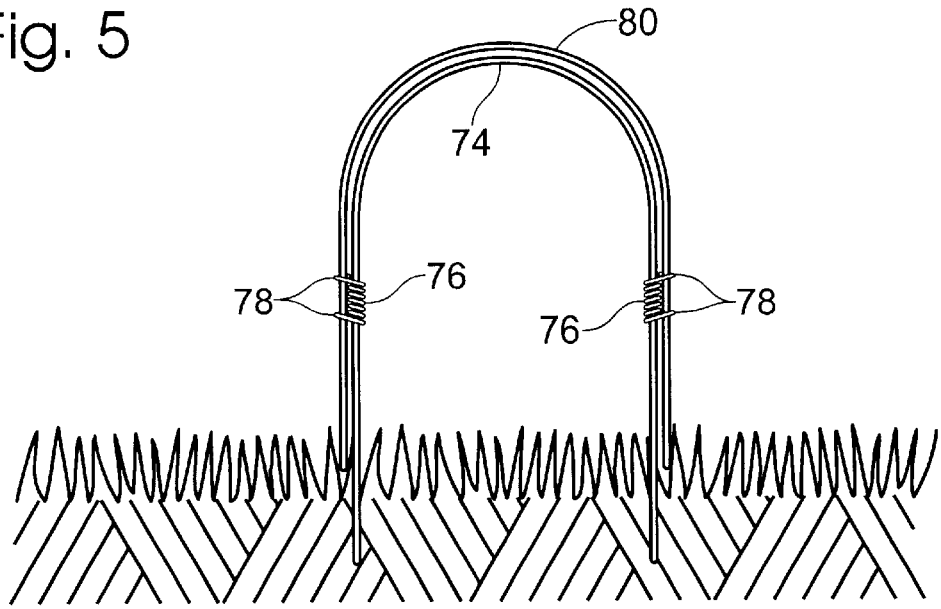
FIG. 5 is an elevational view of a first embodiment of an illuminated wicket, showing the wicket inserted into the ground.
Figure 6:
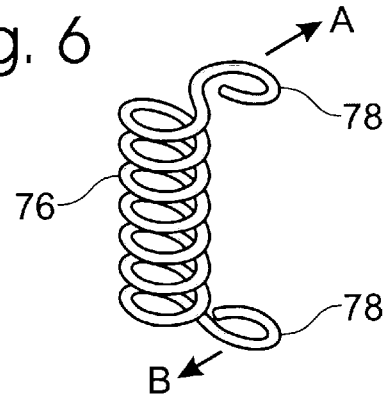
FIG. 6 is a perspective view of a torsional spring used in connection with the wicket shown in FIG. 5.

The present invention thus utilizes rather conventional wire wickets, and combines those wickets with novel features that solves the problems associated with the prior art. Referring now to FIG. 5, a conventional wicket 74 is shown as it used inserted into the ground. The glow-wicket holder of the present invention comprises a torsional spring 76 having two or more aligned exterior loops 78 to hold the necklace 80. The interior diameter of spring 76 when relaxed is somewhat smaller than the outer diameter of the wire used for wicket 74. As such, the springs grip wicket 74 securely when attached thereto. As in FIG. 5, exterior loops 78 retain necklace 80 in place on wicket 74. Since the necklace is bendable and conforms to the shape of the wicket when attached as shown in FIG. 5, the perceived nighttime effect is a lighted wicket. Loops 78 also are used as handles that allow the spring to be loosened and slipped onto the shafts of the conventional wickets. Referring to FIG. 6, this is easily accomplished by using the thumb and forefinger to azimuthally twist the spring such that the inner diameter through spring 76 is increased. This is done by pushing loops 78 in the directions A and B as shown in the arrows in FIG. 6. In the resulting expanded state, spring 76 is easily slipped onto and off of each of the downwardly extending arms of the wicket 74. When released, the spring is reduced in diameter and is tightly held onto the arms of wicket 74.

The only way that spring 76 can be removed is by repeating the process of expanding the springs by pushing loops 78 in opposite directions, and then sliding the springs off of the wicket. Although this is an easy and natural task when done by hand, it is impossible for the impact of a ball to simultaneously create these forces. Thus torsional springs 76 will not unintentionally separate from wickets 74. There are accordingly no interruptions in play caused by the impacts of normal play, no loss of parts in the dark, and no lost or lose parts becoming projectiles during lawn mowing. In the preferred embodiment it is desirable that springs 76 be made of a corrosion resistant material such as zinc coated spring steel or stainless steel.

Figure 7:
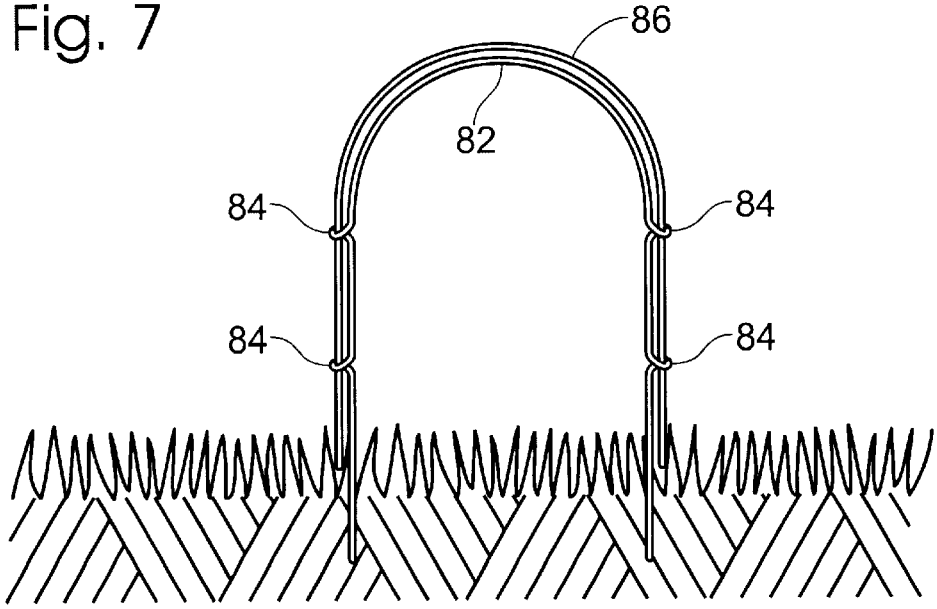
FIG. 7 is an elevational view of an alternative embodiment of an illuminated wicket, showing the wicket inserted into the ground.

Alternatives to torsional springs 76 that also solve some of the problems inherent in the prior art include the embodiment shown in FIG. 7. Wicket 82 in FIG. 7 is fabricated from standard wire and includes two or more loops 84 formed in each of the downwardly extending arms of the wicket. These loops retain a necklace 86. Moreover, yet another alternative would be a pair of receiving tube sections permanently attached (for instance, by welding) to the outer-facing side of the wickets. The tubes receive the ends of the necklace.

As an alternative to the approaches described above, which rely upon a standard wire wicket used in combination with a chemoluminescent necklace, the necklaces themselves may be utilized as the wickets. The strength and resilience of the necklaces allow them to maintain their shape after being struck by croquet balls. In fact, the chemoluminescent wickets are more apt to spring back to their original hoop shape after being struck by a ball than standard wire wickets. Even after the chemicals are spent and light is no longer emitted, the chemoluminescent wickets may be used as wickets for standard daytime play.

Figure 8:
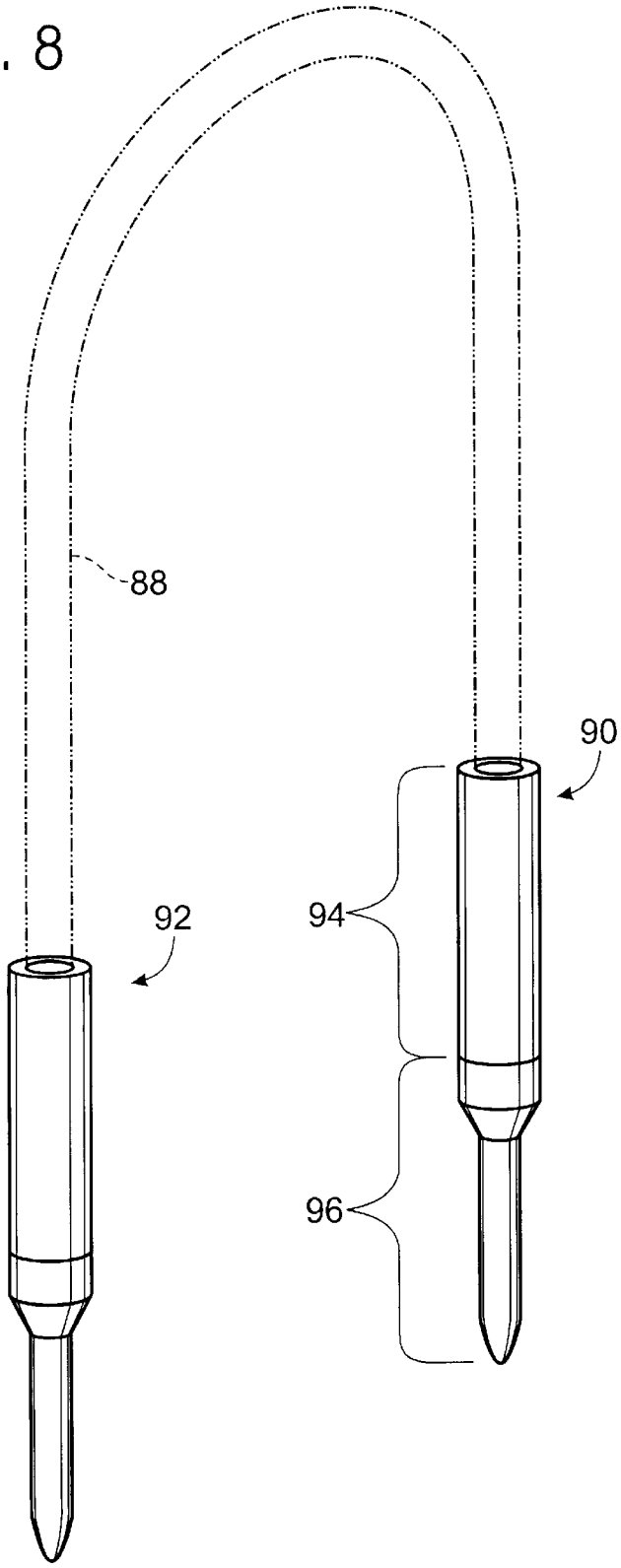
FIG. 8 is yet another alternate embodiment of an illuminated wicket for use in connection with the present invention.

Of course, while existing chemoluminescent necklaces provide a ready supply of chemoluminescent wickets, similarly designed chemoluminescent rods may be used that have design features that enhance the suitability for croquet use. One design enhancement would be to lengthen and taper the ends of the chemoluminescent wickets so they can be more easily inserted into the earth. Another method for holding the chemoluminescent wickets is illustrated in FIG. 8. In this embodiment opposite ends of chemoluminescent necklace 88 are inserted into a pair of identical wicket holders 90 and 92. With reference to wicket holder 90, the holder comprises an upper translucent tube 94 having an interior bore sized to receive necklace 88, and through which luminescence is transmitted. A tapered, pointed ground post 96 is connected to tube 94 for insertion into the ground. Post 96 is preferably brightly colored so that it may be readily found in the lawn, particularly if it is dark and necklace 88 has become separated from wicket holders 90 and 92. In addition, phosphorescent pigments may be added to the components of wicket holders 90 and 92. Zinc sulfide and strontium aluminate are two examples of phosphorescent pigments that can be incorporated into plastics or paints used in connection with wicket holders 90 and 92. The phosphorescent pigments are in close proximity to the light emitted by the chemoluminescent necklace 88, and so are continually being excited to emit light. If necklace 88 and wicket holders are separated during nighttime play, the wicket holders are easily located due to their phosphorescent glow. In order for this to be effective, it is important to use necklaces 88 that emit light with a wavelength shorter than the light emitted by the chemoluminescent pigments in wicket holders 90 and 92. Commercially available chemoluminescent necklace materials and phosphorescent pigment materials are available that satisfy the wavelength condition for adequate glow.

Stakes and Mallets

Figure 9:
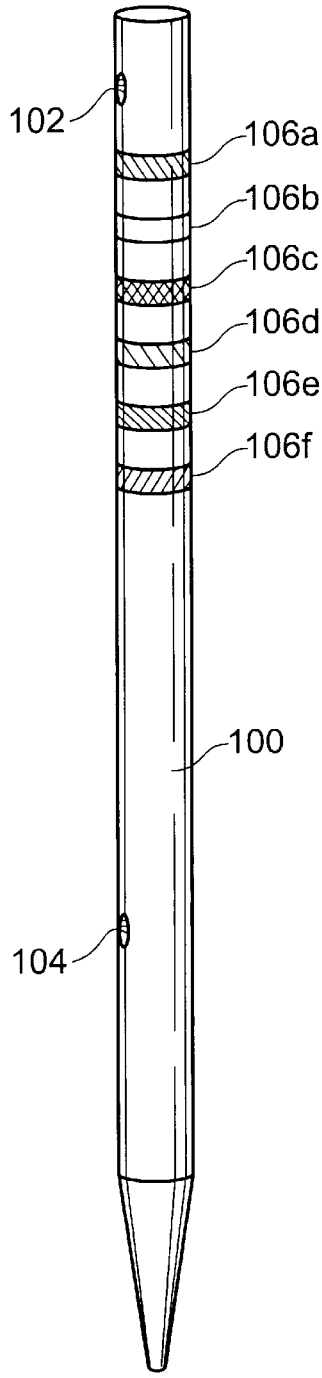
FIG. 9 is a perspective view of a croquet stake used in connection with this invention.

Referring to FIG. 9, the stakes 100—two of which are typically used in a game of croquet—are made more visible for nighttime play in several ways. The first is to use a bright or white material for the stake, or to paint the stake a bright color such as white. Since the stake is often located in close proximity to one or more wickets in standard croquet layouts, light from the chemoluminescent wicket is reflected by the stake, making it visible even in low-light conditions. Enhancements include attaching additional chemoluminescent devices to the stakes, or using phosphorescent pigments on the stake. One method of attaching a chemoluminescent device to the stake is form small holes 102 and 104 at the top and bottom, respectively, of the stake, perpendicular to the long axis of the stake. One end of a chemoluminescent necklace (not shown) can be inserted though top hole 102 and the necklace coiled around the stake with the opposite end of the necklace inserted through bottom hole 104. As is traditional with croquet stakes, certain identifying indicia such as color bands 106*a* through 106*f*, each of which represent a different color, encircle the stake.

Similar modifications may be made to the mallets (not shown).

While the present invention has been described in terms of the best mode of a preferred embodiment, it will be appreciated by one of ordinary skill that the spirit and scope of the invention is not limited to those embodiments, but extend to the various modifications and equivalents as defined in the appended claims.

We claim:

1. A game ball, comprising:

an opaque hollow spherical shell defining a hollow interior defining a interior surface;

a receptacle formed in said shell for receiving a light source; and plural holes in the shell opening to the hollow interior; and a light-reflecting coating on the interior surface.

2. The game ball of claim 1 wherein the receptacle further comprises a helical spring defining an axial tube, the spring having first and second opposite ends, and wherein the shell includes axially opposed first and second openings and the first end of the spring engages the first opening and the second end of the spring engages the second opening.

3. The game ball of claim 2 wherein the axially opposed first and second openings have a first diameter, and the first and second opposite ends of the spring define second diameters that are greater than the first diameter.

4. The game ball of claim 3 including a circumferentially recessed portion in the shell around each of the opposed first and second openings and wherein the first and second opposite ends of the spring engage the respective first and second openings at the circumferentially recessed portions.

5. The game ball of claim 4 wherein the shell defines a spherical outer surface and the first and second opposite ends of the spring are recessed below the outer surface.

6. The game ball of claim 2 wherein the light source comprises a chemoluminescent light stick, and including means for retaining the chemoluminescent light stick in the axial tube.

7. The game ball of claim 6 wherein the means for retaining a chemoluminescent light stick in the axial tube further comprises an end portion of the spring bisecting an opening into the axial tube.

8. The game ball of claim 1 wherein the hollow spherical shell defines an interior surface and the interior surface include light scattering means.

9. The game ball of claim 1 wherein the spherical shell defines an integrating sphere.

10. A game ball, comprising:

an opaque spherical shell having an outer surface and a hollow core defined by an inner surface having a reflective coating applied thereto;

light source retaining means for retaining a source of light in the hollow core; and holes formed in the shell and opening to the hollow core.

11. The game ball of claim 10 wherein the light source retaining means further comprises:

axially opposed first and second openings in the shell, each having a first diameter;

a helical spring having first and second opposite ends, each having a second diameter that is greater than the first diameter;

wherein the first end of the spring engages the shell around a periphery of the first opening, and the second end of the spring engages the shell around a periphery of the second opening.

12. The game ball of claim 11 wherein the helical spring between the first and second ends defines an axial tube configured for receiving a chemoluminescent light source.

13. The game ball of claim 12 pitch of the helical spring at the first and second ends is less than the pitch of the helical spring at a center portion thereof.

14. The game ball of claim 13 wherein the inner surface further comprises light reflecting means.

15. The game ball of claim 14 wherein the light scattering means comprises a white coating.

16. A ball for use in day or nighttime play of croquet and bocce, comprising:

an opaque spherical shell having an outer surface and a hollow interior defined by an inner surface, the interior surface defining a reflective coating defining an integrating sphere;

a plurality of openings formed in the shell and opening to the hollow interior, at least two of the openings in the plurality defining axially opposed openings configured for retaining a receptacle for retaining a chemoluminescent light source in the hollow interior; and a receptacle for retaining a chemoluminescent light source in the hollow interior.

17. The ball of claim 16 wherein the receptacle is further defined by a helical spring having first and second opposite ends, each end of the spring engaging a respective one of the at least two axially opposed openings, and wherein the spring defines an axial tube having a tube diameter.

18. The ball of claim 17 including a chemoluminescent light stick in the axial tube.

19. The ball of claim 18 wherein the light stick has a light stick diameter that is less than the tube diameter.

20. The ball of claim 19 including means for retaining the light stick in the axial tube.

* * * * *